United States Patent [19]

Hecker

[11] 4,357,800

[45] Nov. 9, 1982

[54] ROTARY HEAT ENGINE

[76] Inventor: Walter G. Hecker, 3401 McHenry Ave., Cincinnati, Ohio 45225

[21] Appl. No.: 104,749

[22] Filed: Dec. 17, 1979

[51] Int. Cl.[3] ..... F02G 1/06; F02G 1/04

[52] U.S. Cl. ..... 60/519; 60/650; 60/682; 418/29

[58] Field of Search ..... 62/6; 60/650, 682, 518, 60/519; 418/29

[56] References Cited

U.S. PATENT DOCUMENTS

| | | | |
|---|---|---|---|
| 2,067,453 | 1/1937 | Lee | 60/682 |
| 2,952,138 | 9/1960 | Russell et al. | 60/671 |
| 3,169,375 | 2/1965 | Velthuis | 60/670 |
| 3,426,525 | 2/1969 | Rubin | 60/519 |
| 3,483,694 | 12/1969 | Huber et al. | 60/519 |
| 3,488,945 | 1/1970 | Kelly | 60/519 |
| 3,553,963 | 1/1971 | Kelly | 60/519 |
| 3,630,022 | 12/1971 | Jubb | 60/650 X |
| 3,744,245 | 7/1973 | Kelly | 60/519 |
| 3,800,526 | 4/1974 | Wahnschaffe | 60/519 |
| 3,835,650 | 9/1974 | Chesmejef | 60/670 X |
| 3,867,815 | 2/1975 | Barrett | 60/682 |
| 4,009,573 | 3/1977 | Satz | 60/519 |
| 4,089,174 | 5/1978 | Posnansky | 60/682 X |
| 4,206,604 | 6/1980 | Reich | 60/519 |

FOREIGN PATENT DOCUMENTS

| | | | |
|---|---|---|---|
| 2035355 | 2/1972 | Fed. Rep. of Germany | 418/29 |
| 197709 | 9/1977 | France | 418/29 |

*Primary Examiner*—Allen M. Ostrager
*Attorney, Agent, or Firm*—Frost & Jacobs

[57] ABSTRACT

A rotary external combustion heat engine for furnishing mechanical energy from a source of heat. The engine includes a ring-like stator having an oval rotor chamber enclosing a cylindrical rotor eccentrically placed within the chamber to define a high displacement high temperature fluid chamber and a lower displacement low temperature fluid chamber. A plurality of extensible vanes extend outwardly from the rotor in sliding contact with the inner surface of the rotor chamber. A source of heat supplies thermal energy to fluid supplied to the high temperature chamber, while a heat sink cools fluid supplied to the low temperature chamber. An economizer heat exchanger is also provided for preheating the working fluid. The relative position of the rotor within the rotor chamber is adjustable for varying the relative displacement of the fluid chambers to control engine working parameters. In another embodiment, a first heat engine is utilized as a motor and is mechanically coupled to a second heat engine utilized as a heat pump for providing an external combustion heat pump or refrigeration unit.

13 Claims, 5 Drawing Figures

ROTARY HEAT ENGINE

SUMMARY OF THE INVENTION

The present invention relates to an external combustion engine for converting heat energy into rotational mechanical energy with improved power output in light of the heat input and engine weight and size. Furthermore, the operation of the engine is reversible so that it may be used as a highly efficient heat pump when the engine shaft is driven by an outside source of mechanical energy.

In a preferred embodiment, the rotary heat engine of the present invention comprises a ring-like stator having an elongated interior oval rotor chamber defined by a pair of adjoining lobes forming a high displacement high temperature fluid chamber and a low displacement low temperature fluid chamber, respectively. Each of the high and low temperature chambers includes an inlet port for admitting working fluid into the chamber, and an outlet port circumferentially spaced from the inlet port for exhausting working fluid.

A substantially cylindrical slotted rotor is rotatably and eccentrically mounted within the rotor chamber such that the high temperature chamber defines a greater volume than the low temperature chamber. The rotor contains a plurality of outwardly extending spring biased sliding vanes, the outer ends of which are in sliding engagement with the inner surface of the rotor chamber, and the sides of which are in sliding engagement with the inner surface of the end plates, to provide a sliding seal therealong.

A fluid heating path is formed between the outlet port of the low temperature fluid chamber and the inlet port of the high temperature fluid chamber, and includes a fluid heating device for heating the working fluid by combustion heat, waste heat, geothermal, solar, etc. A bypass path may also be provided around the fluid heater for regulating the amount of heat supplied to the working fluid, and consequently the power output from the heat engine rotor.

A fluid cooling path is similarly formed between the outlet port of the high temperature chamber and the inlet port of the low temperature chamber, and includes heat rejection means for removing heat energy from the working fluid. An economizer heat exchanger may also be provided between the cooling and heating paths for preheating fluid supplied to the fluid heater.

The heat engine of the present invention is designed to optimize operation of the engine with changes in varying temperatures, heat availability and mechanical load by modifying the eccentricity of the rotor within the rotor chamber to change the relative working volumes of the high temperature and low temperature fluid chambers. This operation is accomplished by varying the relative position of the cylindrical rotor with respect to the oval-shaped rotor chamber to modify the relative displacements of the high and low temperature chambers.

In another embodiment, the rotor shafts of similarly configured heat engines may be coupled with one engine working as a motor and the other as a heat pump to advantageously form an external combustion powered or heating unit. In this configuration, the outlet port of the low temperature chamber of a first heat engine, which serves as a motor, is coupled through a fluid heater to the inlet port of the high temperature chamber of the motor. The outlet port of the high temperature chamber of the motor is coupled through the heat rejecting part of a heat exchanger to the inlet port of the low temperature chamber of the motor. Fluid leaving the heat receiving part of the heat exchanger is admitted to the inlet port of the high temperature chamber of the second engine which serves as a heat pump where the fluid is heated further by compression. The hot fluid leaving the high temperature chamber of the second engine is routed through a heat rejection device where it gives its heat to a warm reservoir, and is then admitted to the low temperature chamber of the heat pump where it loses heat due to expansion. After leaving the low temperature chamber of the heat pump, the cold fluid is routed through a fluid heating device where it picks up heat from a cold reservoir. Subsequently, the fluid is routed through the heat receiving part of the heat exchanger where it picks up the waste heat from the first engine. Economizer means may also be provided between the heating and cooling fluid flow paths as required.

In another embodiment, the outlet port of the low temperature chamber of the first heat engine, which serves as a motor, is coupled through a fluid heater and the heat receiving part of a heat exchanger to the inlet port of the high temperature chamber, while the outlet port of the high temperature chamber of the motor is coupled to the inlet port of the low temperature chamber of the motor through a heat rejection device where the working fluid loses heat to a warm reservoir. A second heat engine is coupled to the first heat engine to serve as a heat pump. The outlet port of the low temperature chamber of the heat pump is coupled to the inlet port of the high temperature chamber of the heat pump through a fluid heating device where the working fluid receives heat from a cold reservoir. The output port of the high temperature chamber of heat pump is connected to the inlet port of the low temperature chamber of the heat pump through the heat rejection part of the heat exchanger where the working fluid loses heat to preheat the fluid serving the motor.

Further details of the invention will become apparent from the description which follows.

BRIEF DESCRIPTION OF THE DRAWING

FIG. 5 is a schematic diagram of a second embodiment using a pair of mechanically coupled heat engines operating as an external combustion powered refrigeration unit.

DETAILED DESCRIPTION

Figure 1:
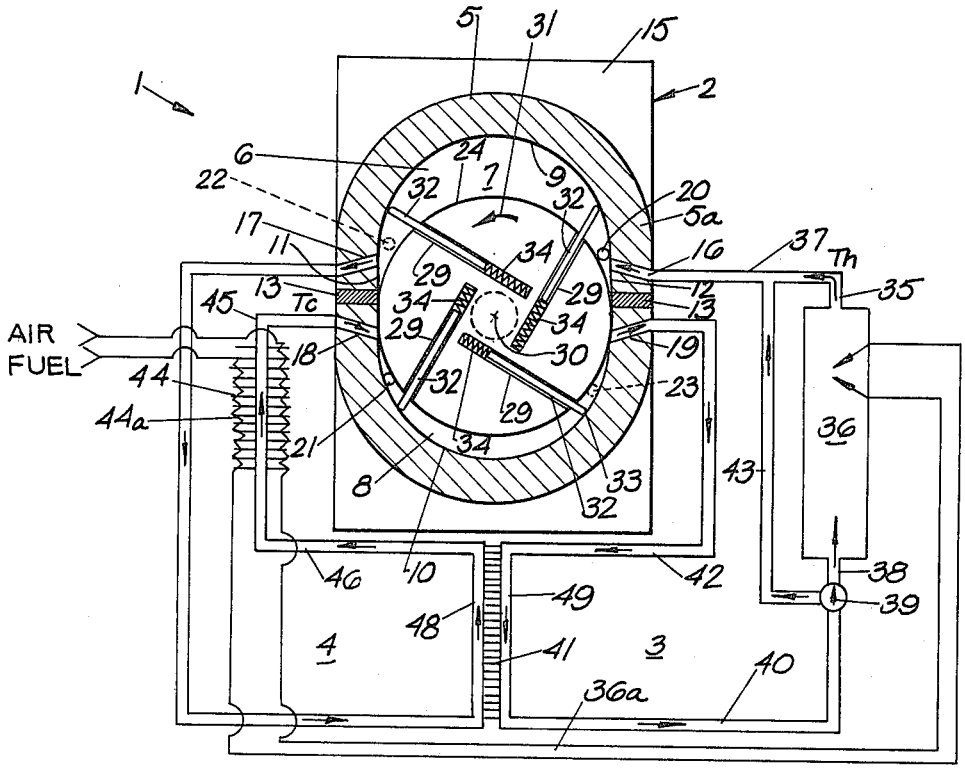
FIG. 1 is a schematic diagram of the heat engine system of the present invention illustrating a side view, partially in cross section, of the rotary heat engine.
Figure 2:
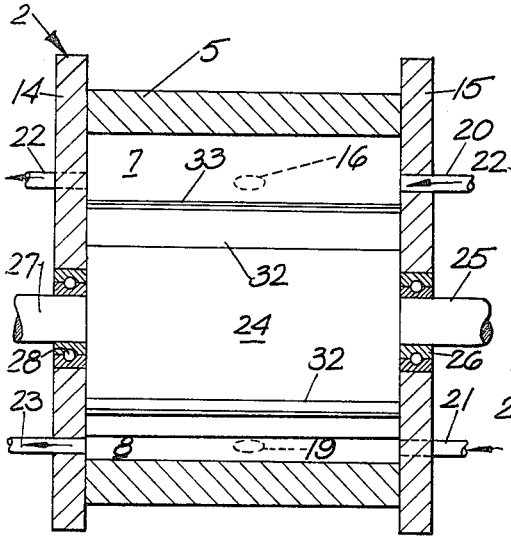
FIG. 2 is a front elevation view, partially in cross section, of the rotary heat engine of the present invention.
Figure 3:
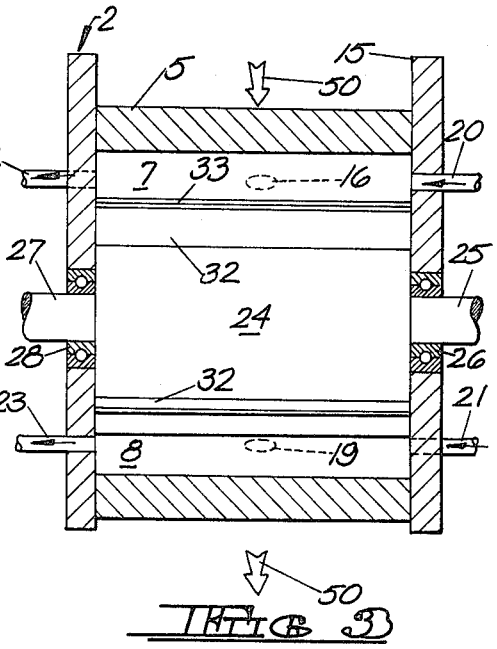
FIG. 3 is a front elevation view, partially in cross section, of the heat engine of the present invention with the rotor eccentrically displaced with respect to the stator from the position shown in FIG. 2.

The rotary heat engine system of the present invention is generally illustrated at 1 in FIG. 1–FIG. 3. Fundamentally, system 1 comprises a rotary heat engine 2 which produces rotational mechanical energy by means of a working fluid flowing in fluid heating loop 3 and fluid cooling loop 4. As will be explained in more detail hereinafter, the working fluid, such as hydrogen, helium, nitrogen, mercury vapor, tetrafluoromethane, etc., is heated in the heating loop 3, undergoes an expansion cycle in heat engine 2, is cooled in a cooling loop 4, and finally undergoes a compression cycle in engine 2. It will be noted that the working fluid flow is unidirectional, thereby avoiding considerable energy losses which have previously occurred with heat engines using reciprocating elements where masses of highly condensed gases must be alternately accelerated in opposite directions.

Rotary heat engine 2 generally includes an oval stator or cam ring 5. The interior of ring 5 forms an oval rotor chamber 6 defined by a pair of adjoining lobes forming a high temperature fluid chamber 7 and a low temperature fluid chamber 8. For purposes of an exemplary showing, ring 5 is constructed in two parts, an upper semi-cylindrical-like ring segment 5*a*, and a substantially identical lower semi-cylindrical-like ring segment 5*b*. Each ring segment comprises an outer curved portion terminating in a pair of spaced substantially parallel arm members. This construction results in a rotor chamber having substantially circular upper and lower surfaces 9 and 10, respectively, and intermediate plane parallel surfaces 11 and 12. In general, surfaces 11 and 12 will be of sufficient length to provide the desired range of adjustability between the rotor and stator as will be explained in more detail hereinafter. The ends of the arm portions adjacent surfaces 11 and 12 are substantially flat and parallel to facilitate joining the ring segments together by means of a pair of thin flat thermally insulating plates or gaskets 13 which prevent transfer of heat between ring segments 5*a* and 5*b*. While for purposes of an exemplary showing, rotor chamber 6 has been described and illustrated as having rounded upper and lower surfaces, as well as intermediate substantially planar surfaces, it will be understood that other shapes may be utilized for the rotor chamber. Furthermore, ring 5 may be of unitary construction rather than made in separate parts.

Rotor chamber 6 is closed by means of a pair of substantially flat end plates 14 and 15 abuttingly and slidably engaging the end surfaces of stator ring 5. In general, end plates 14 and 15 will be urged firmly against the end surfaces of ring 5 by means not shown to insure a fluid tight seal therebetween. The sliding fit between these members permits adjustment of the engine characteristics as will be described in more detail below. As best shown in FIG. 1, upper ring segment 5*a* contains an orifice 16 extending therethrough adjacent surface 12 and forming an inlet port for admitting working fluid into high temperature chamber 7. As illustrated in FIG. 1, inlet port 16 extends obliquely through the wall of upper ring 5*a* so that working fluid is directed generally toward upper surface 9. A second orifice 17 spaced circumferentially from inlet port 16 adjacent surface 11 forms an outlet port for exhausting working fluid from high temperature chamber 7. In general, outlet port 17 will also extend obliquely through the wall of upper ring segment 5*a* so that the inlet end of port 17 is generally directed toward upper surface 9 of high temperature chamber 7. In general, this construction is similar to that commonly found in vane pumps.

Lower ring segment 5*b* is similarly configured and includes an orifice 18 extending obliquely through the wall of lower ring segment 5*b* adjacent surface 11 beneath outlet port 17. Orifice 18 forms an inlet port for delivering working fluid to low temperature chamber 8. Similarly, a second orifice 19 is circumferentially spaced from inlet port 18 underlying inlet port 16 to form an outlet port for exhausting working fluid from low temperature chamber 8.

As described and illustrated above, ports 16–19 extend through the walls of stator ring 5 as illustrated in FIG. 1, and by dashed lines in FIG. 2 and FIG. 3. However, the present invention contemplates an alternate arrangement where working fluid is introduced into and exhausted from rotor chamber 6 through appropriate orifice ports extending through one or both end plates 14 and 15. For example, the inlet port to high temperature chamber 7 may be formed by an orifice 20 extending through end plate 15 adjacent surface 12, while working fluid may be exhausted from high temperature chamber 7 by means of an outlet port formed by orifice 22 extending through end plate 14 adjacent surface 11. Similarly, working fluid may be introduced into low temperature chamber 8 by means of an inlet port formed by orifice 21 extending through end plate 15 adjacent surface 11, with working fluid being exhausted from low temperature chamber 8 by means of orifice 23 forming an outlet port extending through end plate 14 adjacent surface 12. As illustrated in FIG. 1, orifices 22 and 23 have been illustrated in dashed lines to illustrate their relative position on end plate 14.

A substantially cylindrical slotted rotor 24 is eccentrically disposed within rotor chamber 6 such that the volume defined by high temperature chamber 7 is greater than the volume defined by low temperature chamber 8. Consequently, the displacement of high temperature chamber 7 will be greater than the displacement of low temperature chamber 8. One end of rotor 24 terminates in a shaft 25 rotatably supported in ball bearing 26, for example. Similarly, the opposite end of rotor 24 may terminate in a similar shaft 27 rotatably supported by end plate 14. This construction permits rotor 24 to rotate freely about its axis, with mechanical energy being supplied to or removed from either of shafts 25 or 27. Alternatively, rotor 24 may be rotatably supported by a single shaft passing through either of end plates 14 or 15, as is well understood in the art.

Rotor 24 is supplied chordwise with four elongated slots 29 disposed around axis of rotation 30, such that adjacent slots 29 are substantially perpendicular to each other. As used herein, "chordwise" means that each slot extends from a point on the periphery of rotor 24 to a point spaced from the axis of rotation 30. For purposes of an exemplary showing, slots 29 are arranged to extend slightly beyond the axis of rotation 30, and are inclined in the direction of rotation of rotor 24 as depicted by directional arrow 31.

Each slot 29 slidably receives an elongated extensible vane 32 having a rounded outer tip 33 which slidably engages the inner surface of rotor chamber 6 to provide a sliding seal. Vanes 32 may be biased outwardly by means of one or more compression springs 34 positioned between the lower surface of slot 29 and the inner end of vane 32. This construction permits vane 32 to move from a fully retracted position when passing over surfaces 11 or 12, to a fully extended position when passing over surfaces 10 or 9 respectively. Furthermore, the vanes are inclined in the direction of rotor rotation to facilitate retraction.

The remaining elements of rotary heat engine system 1 are illustrated in FIG. 1. The outlet end 35 of a fluid heating means 36 is connected by means of fluid conduit 37 to inlet port 16 of high temperature chamber 7. Fluid heater 36 may include any type of heat source capable of elevating the temperature of the working fluid flowing through it, such as a fuel burner, waste heat exchanger, solar heater, geothermal heater, etc. The inlet end 38 of fluid heater 36 is connected by means of fluid conduit 40 to the heat receiving side 49 of economizing heat exchanger 41. The inlet end of heat exchanger 41 is connected by means of fluid conduit 42 to outlet port 19 of low temperature chamber 8 to complete fluid heating path 3. A fluid heater bypass channel 43 may also be provided around fluid heater 36 and optionally controlled by valve 39 to regulate the engine power throughout. This arrangement provides a convenient means for controlling the heat energy supplied to heat engine 2 without restricting the flow of the working fluid. The fuel supply (not shown) for heat source means 36 may be closely coupled to valve 39, or may be thermostatically controlled as a function of the fluid temperature at outlet end 35 of fluid heater 36, or both. In addition, means may be provided for preheating the combustion materials. For example, as illustrated in FIG. 1, air and fuel fed through conduits 36*a* to a fuel burner comprising fluid heater 36, may be preheated by heat exchange means 44*a* using waste heat from heat rejection means 44.

Fluid cooling path 4 is formed by heat rejection means 44, the outlet end of which is connected by means of fluid conduit 45 to inlet port 18 of low temperature chamber 8, and the inlet end of which is connected by means of fluid conduit 46 to the outlet end of the heat rejecting side 48 of economizer heat exchanger 41. The inlet end of the heat rejecting side of heat exchanger 41 is connected by means of fluid conduit 47 to outlet port 17 of high temperature chamber 7. Heat rejection means 44 may comprise any device for removing heat from the working fluid before it enters the low temperature chamber of heat engine 2 such as a cooling tower, heat exchanger communicating with a low temperature sink, heat radiator, etc. It will be understood that in the embodiment described, fluid heater 36, heat exchanger 41, and heat rejection means 44 may be separate devices, or constructed as integral parts of heat engine 2.

When heat engine 2 is operated as a motor, high temperature chamber 7 works as an expansion device for driving rotor 24, while low temperature chamber 8 serves as a compression device. With rotor 24 turning in the direction indicated by directional arrow 31, working fluid at a low temperature $T_c$ enters low temperature chamber 8 by way of inlet port 18 and exhausts low temperature chamber 8 through outlet port 19 into the heat receiving portion of heat exchanger 41 where the working fluid is economically preheated. The working fluid is then heated by fluid heater 36, emerging therefrom at a high temperature $T_h$, and enters high temperature chamber 7 by way of inlet port 16. The working fluid is expanded in high temperature chamber 7, and exits by way of outlet port 17 to the heat rejecting side of heat exchanger 41 where it gives up a portion of its remaining heat energy to the cooler working fluid which has exited low temperature chamber 8. The working fluid then proceeds through heat rejection means 44 where it is cooled by low temperature $T_c$. The simultaneous operating cycles result in a positive pressure differential between heating path 3 and cooling path 4. Since the vanes in chamber 7 expose a greater area to the pressurized working fluid than vanes in chamber 8, the summation of forces exerted on the vanes results in a net torque driving rotor 24 counterclockwise, thus perpetuating the rotation and maintaining the driving pressure differential.

In the application where heat engine 2 is operated as a heat pump for transferring heat from a cold reservoir to a warmer reservoir, high temperature chamber 7 operates as a compressor, while the less voluminous low temperature chamber 8 serves as an expansion device to recover mechanical energy. In this situation, an outside mechanical prime mover (not shown) turns rotor 24 in a clockwise direction, such that the preheated working fluid is compressed in high temperature chamber 7 and forced through loop 3 which now forms a heat rejection path. This compression raises the temperature of the fluid to $T_h$ making heat available at means 36, which now functions as a heat rejector, e.g. a radiator. Working fluid exhausted from heat rejector means 36 passes through the now heat rejecting side 49 of heat exchanger 41 where it is further cooled and serves to economically preheat fluid flowing through the opposite side of the heat exchanger. The cooled working fluid leaving heat exchanger 41 enters low temperature chamber 8 through port 19 which functions as an expansion device to return part of the mechanical energy used in compressing the fluid to drive shaft 25 or 27 of engine 2. This expansion process cools the working fluid to temperature $T_c$ which is less than the temperature of the cold reservoir. Therefore the fluid will pick up heat from the cold reservoir; i.e. the temperature of the fluid is raised by its passage through what is now the heat receiving device 44 of the system and further by passage through the heat receiving side 48 of heat exchanger 41 to complete the heat pumping cycle.

As described hereinabove, the operation of the rotary heat engine system 1 may be optimized for changes in varying temperatures, heat availability and mechanical load, either manually or automatically, by modifying the eccentricity of rotor 24 within rotor chamber 6 to change the relative working volumes or displacement of high temperature fluid chamber 7 and low temperature fluid chamber 8. For example, as illustrated in FIG. 2, stator ring 5 has been adjusted with respect to rotor 24 so that the volume of high temperature chamber 7 is significantly greater than the volume of low temperature chamber 8 to accommodate a particular set of working conditions. However, in FIG. 3, stator ring 5 has been adjusted downwardly as shown by directional arrows 50 so that the volume of high temperature chamber 7 is only slightly greater than the volume of low temperature chamber 8 to accommodate a different set of operating conditions.

In general, rotor 24 and rotor chamber 6 will be dimensioned to insure a fluid-tight seal between the ends of rotor 24 and the inner bearing surfaces of end plates 14 and 15, to prevent leakage of the working fluid between chamber 7 and chamber 8.

Figure 4A:
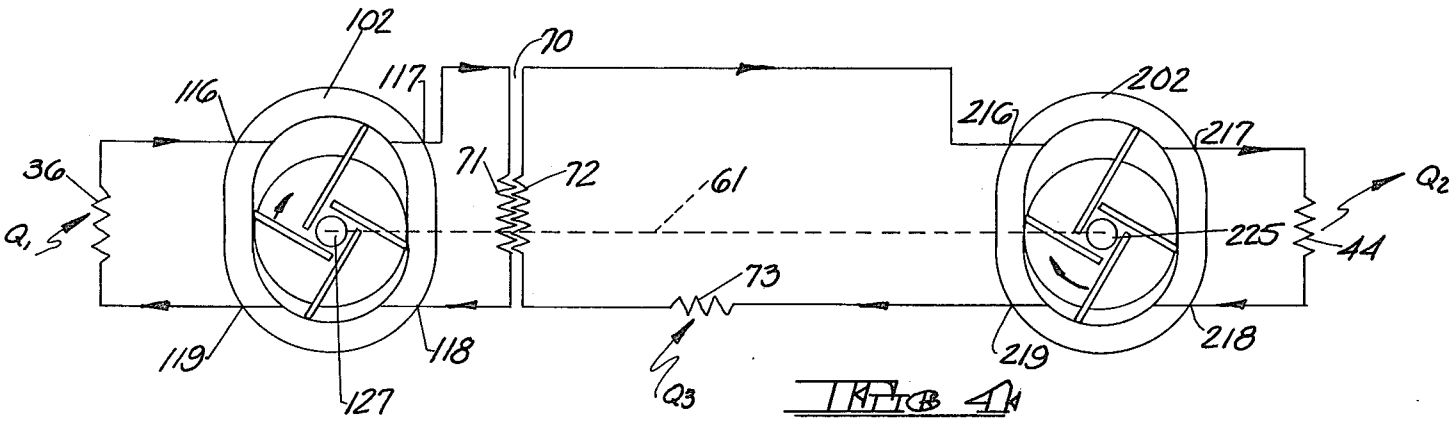
FIG. 4 is a schematic view illustrating a first embodiment of a pair of mechanically coupled heat engines operating as an external combustion powered heating unit.
Figure 4B:
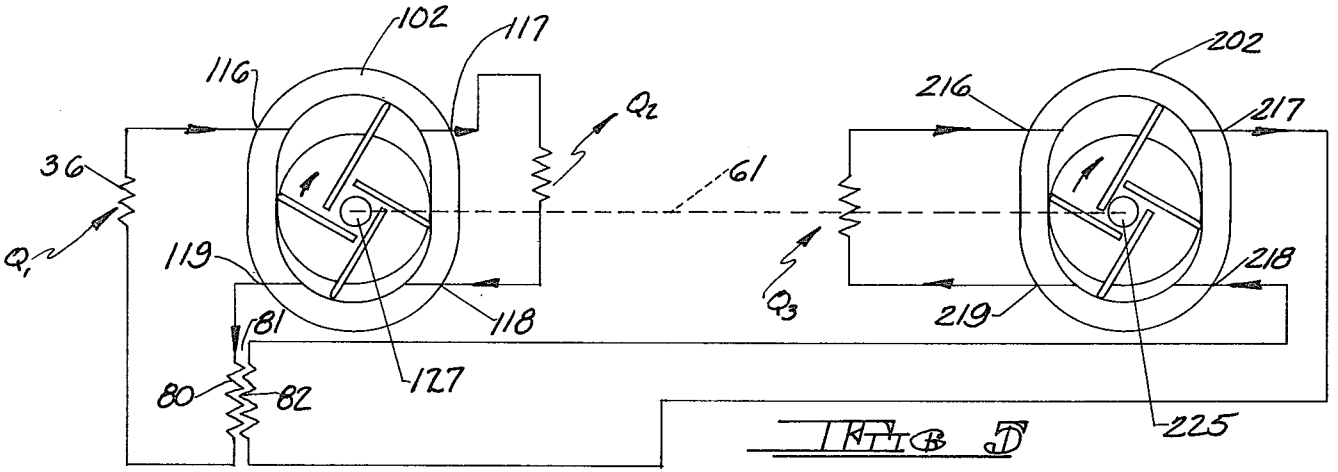

In an alternative embodiment, two heat engines 102 and 202, one operating as a motor and the other operating as a heat pump, may be coupled mechanically to form an external combustion powered air conditioning or refrigeration or heating unit, such as illustrated schematically in FIG. 4 and FIG. 5. In these figures, elements structurally similar to those appearing in FIG. 1–FIG. 3 have been similarly designated.

The arrangement of FIG. 4 finds utility as a heating device. The drive shaft 127 of a first heat engine 102 operating as a motor has been mechanically connected by means of a coupling or the like, designated schematically by dashed line 61 in FIG. 4, to the drive shaft 225 of a second heat engine 202 operating as a heat pump. Each heat engine is structurally similar to heat engine 2 described above. The outlet port 119 of the low temperature chamber of heat engine 102, which serves as a motor is coupled through a fluid heater 36 where heat $Q_1$ is added to the fluid, to the inlet port 116 of the high temperature chamber of the motor 102. The outlet port 117 of the high temperature chamber of motor 102 is coupled through the heat rejecting part 71 of a heat exchanger 70 to the inlet port 118 of the low temperature chamber of motor 102. Fluid leaving the heat receiving part 72 of heat exchanger 70 is admitted to the inlet port 216 of the high temperature chamber of the second heat engine 202, which serves as a heat pump, where the fluid is heated further by compression. The hot fluid leaving the high temperature chamber of the second engine 202 via port 217 is routed through a heat rejection device 44, where heat $Q_2$ is given up to a warm reservoir such as a room to be heated. The fluid then flows to the input port 218 of the low temperature chamber of heat pump 202 where it loses heat due to expansion. After leaving the low temperature chamber of heat pump 202 through port 219, the cold fluid is routed through a fluid heating device 73 where the fluid absorbs heat $Q_{13}$ from a cold reservoir, such as a body of water, for example. Subsequently, the fluid is routed through the heat receiving part 72 of heat exchanger 70 where it picks up waste heat from motor 102, thus completing the cycle.

The embodiment of FIG. 5 is useful for cooling purposes and includes similar heat engines 102 and 202 acting as motor and heat pump, respectively, which are connected by coupling 61. Heat $Q_1$ is added to the fluid in fluid heater 36. The outlet of fluid heater 36 is coupled to inlet port 116 of engine 102. Outlet port 117 of engine 102 is connected to port 118 through heat rejection device 44 which exhausts heat $Q_2$ to a warm reservoir. Port 119 is connected through the heat receiving part 80 of heat exchanger 81 to fluid heater 36 to preheat the fluid. The heat rejecting part 82 of heat exchanger 81 is connected between ports 217 and 218 of heat pump 202, while heat receiving means absorbing heat $Q_3$ from a cold reservoir is connected between ports 216 and 219 of heat pump 202.

In the embodiment of FIG. 4 and FIG. 5, the working fluid associated with heat engine 102 may be different from that used in heat engine 202. In addition, the relative sizes of the heat engines may be different to accommodate particular design requirements.

It will be understood that various changes in the details, materials, steps and arrangements of parts, which have been herein described and illustrated in order to explain the nature of the invention, may be made by those skilled in the art within the principle and scope of the invention as expressed in the appended claims. For example, multiple high and low temperature chambers may be distrubted circumferentially around the circumference of rotor chamber 6 to balance radial bearing strain on shaft bearings 26 and 28.

The embodiments of the invention in which an exclusive property or privilege is claimed are as follows:

1. A rotary heat engine comprising:

a stator having an oval rotor chamber defined by a pair of adjoining lobes forming a high temperature fluid chamber and a low temperature fluid chamber, respectively, each of said fluid chambers including spaced fluid inlet and outlet ports;

a substantially cylindrical rotor rotatably mounted within said rotor chamber such that said high temperature chamber defines a greater volume than said low temperature chamber, said high temperature chamber being separated from said low temperature chamber by the rotor positioned therebetween, said rotor including a plurality of radially extending vane accepting slots;

an extensible vane slidably received in each of said slots, said vanes making sliding contact with the inner wall surface of said rotor chamber to affect a sliding seal;

fluid heating means connected between said low temperature chamber outlet port and said high temperature chamber inlet port for heating fluid admitted into said high temperature chamber;

heat rejection means connected between said high temperature chamber outlet port and said low temperature chamber inlet port for cooling fluid admitted into said low temperature chamber; and means for moving said rotor eccentrically within said rotor chamber to increase or decrease the relative volumes of said high temperature and low temperature chambers, respectively.

2. The heat engine according to claim 1 including heat exchange means for transferring heat from fluid exhausted from said high temperature chamber outlet port to fluid exhausted from said low temperature chamber outlet port.

3. The heat engine according to claim 1 including means for selectively bypassing fluid around said fluid heater means.

4. The heat engine according to claim 1 wherein said fluid heating means comprises a combustion burner using fluid combustibles, said engine including means in association with said heat rejection means for preheating said combustibles.

5. A rotary heat engine comprising:

a stator defining an oval-shaped rotor chamber having a high temperature fluid chamber and a low temperature fluid chamber spaced therefrom, each of said chambers having spaced inlet and outlet ports for respectively admitting fluid into and exhausting fluid from said fluid chambers;

a substantially cylindrical rotor rotatably mounted within said rotor chamber such that said high temperature chamber defines a greater volume than said low temperature chamber, said high temperature chamber being separated from said low temperature chamber by the rotor positioned therebetween, said rotor including a plurality of radially extending vane accepting slots;

an extensible vane slidably received in each of said slots, said vanes being in sliding contact with the inner wall surface of said rotor chamber to affect a sliding seal; and means for moving said rotor eccentrically within said rotor chamber to change the relative volumes of said fluid chambers.

6. The heat engine according to claim 5 wherein the surfaces of said rotor chamber adjoining said high temperature and low temperature fluid chambers are substantially planar and parallel.

7. The heat engine according to claim 5 wherein said stator is formed in two distinct parts, each of said parts defining one of said fluid chambers, said parts being thermally insulated from each other.

8. The heat engine according to claim 5 wherein said slots and said vanes are disposed chordwise in said rotor in the direction of rotor rotation.

9. The heat engine according to claim 5 wherein said ports comprise apertures extending through the walls of said stator.

10. The heat engine according to claim 5 wherein said stator comprises a ring-like member and said engine includes end plates at least one of which slidingly abutts the outer ends of said ring.

11. The heat engine according to claim 10 wherein said ports comprise orifices extending through one or both of said end plates.

12. A rotary heat engine comprising mechanically connected motor means and pump means, said motor means comprising:

(a) a stator defining an oval-shaped rotor chamber having spaced high temperature and low temperature fluid chambers, said chambers having spaced inlet and outlet ports for respectively admitting fluid into and exhausting fluid from said chambers;

(b) a substantially cylindrical rotor rotatably mounted within said rotor chamber such that said high temperature chamber defines a greater volume than said low temperature chamber, said rotor including a plurality of radially extending vane accepting slots; and (c) an extensible vane slidably received in each of said slots, said vanes being in sliding contact with the inner wall surface of said rotor chamber to affect a sliding seal; said pump means comprising;

(d) a stator defining an oval-shaped rotor chamber having spaced high temperature and low temperature fluid chambers, said chambers having spaced inlet and outlet ports for respectively admitting fluid into and exhausting fluid from said chambers;

(e) a substantially cylindrical rotor rotatably mounted within said pump rotor chamber such that said high temperature pump chamber defines a greater volume than said low temperature pump chamber, said pump rotor including a plurality of radially extending vane accepting slots, said pump rotor being connected to said motor rotor; p1 (f) an extensible vane slidably received in each of said pump rotor slots, said pump vanes being in sliding contact with the inner wall surface of said pump rotor chamber to affect a sliding seal;

(g) fluid heating means for heating a working fluid connected between said high temperature inlet port and said low temperature outlet port of said motor means;

(h) a heat exchanger having a heat rejecting part and a heat receiving part, heat being transferred from working fluid flowing through said heat rejecting part to fluid flowing through said heat accepting part, said heat rejecting part being connected between said outlet port of said high temperature chamber of said motor means and said inlet port of said low temperature chamber of said motor means, said heat receiving part including an inlet and an outlet;

(i) a fluid heating device for heating working fluid connected between said low temperature outlet port of said pump means and the inlet of said heat receiving part of said heat exchanger, the outlet of said heat receiving part of said heat exchanger being connected to said high temperature inlet port of said pump means; and (j) heat rejecting means for providing a source of heat connected between said high temperature outlet port and said low temperature inlet port of said pump means.

13. A rotary heat engine comprising mechanically connected motor means and pump means, said motor means comprising:

a stator defining an oval-shaped rotor chamber having a high temperature fluid chamber and a low temperature fluid chamber spaced therefrom, said chambers having spaced inlet and outlet ports for respectively admitting fluid into and exhausting fluid from said chambers;

a substantially cylindrical rotor rotatably mounted within said rotor chamber such that said high temperature chamber defines a greater volume than said low temperature chamber said high temperature chamber being separated from said low temperature chamber by the rotor positioned therebetween, said rotor including a plurality of radially extending vane accepting slots; and an extensible vane slidably received in each of said slots, said vanes being in sliding contact with the inner wall surface of said rotor chamber to affect a sliding seal and; means for moving said rotor eccentrically within said rotor chamber to increase or decrease the relative volumes of said high temperature and low temperature chambers, respectively; said pump means comprising:

a stator defining an oval-shaped rotor chamber having a high temperature fluid chamber and a low temperature fluid chamber spaced therefrom, said chambers having spaced inlet and outlet ports for respectively admitting fluid into and exhausting fluid from said chambers;

a substantially cylindrical rotor rotatably mounted within said pump rotor chamber such that said high temperature pump chamber defines a greater volume than said low temperature pump chamber, said high temperature chamber being separated from said low temperature chamber by the rotor positioned therebetween, said pump rotor including a plurality of radially extending vane accepting slots, said pump rotor being connected to said motor rotor;

an extensible vane slidably received in each of said pump rotor slots, said pump vanes being in sliding contact with the inner wall surface of said pump rotor chamber to affect a sliding seal; and means for moving said rotor eccentrically within said rotor chamber to increase or decrease the relative volumes of said high temperature and low temperature chambers, respectively;

fluid heating means having an inlet and an outlet for heating a working fluid, said fluid heating outlet being connected to said high temperature inlet port of said motor means;

a heat exchanger having a heat rejecting part and a heat receiving part, heat being transferred from working fluid flowing through said heat rejecting part to fluid flowing through said heat accepting part, said heat receiving part including an inlet and an outlet, said heat receiving part inlet being connected to said low temperature outlet port of said motor means, said heat receiving part outlet being connected to said fluid heating means inlet, said heat rejecting part being connected between said high temperature outlet and said low temperature inlet of said pump means;

heat rejecting means for exhausting heat from the working fluid connected between said high temperature outlet port and said low temperature inlet port of said motor means; and a fluid heating device for heating working fluid connected between said high temperature inlet port and said low temperature outlet port of said pump means.

* * * * *